US011154738B2

(12) United States Patent
Tanklevski et al.

(10) Patent No.: US 11,154,738 B2
(45) Date of Patent: Oct. 26, 2021

(54) QUICK-RESPONSE SPRINKLER

(71) Applicant: OBSCHESTVO S OGRANICHENNOI OTVETSTVENNOSTJU "FORNOSOVSKOE NAUCHNO-PROIZVODSTVENNOE PREDPRIAYTIE "GEFEST", Leningradskaya (RU)

(72) Inventors: Leonid Timofeevich Tanklevski, St.Petersburg (RU); Mikhail Aleksandrovich Vasiliev, St.Petersburg (RU); Alexandr Valerevich Arakcheev, St.Petersburg (RU)

(73) Assignee: OBSCHESTVO S OGRANICHENNOI OTVETSTVENNOSTJU "FORNOSOVSKOE NAUCHNO-PROIZVODSTVENNOE PREDPRIYATIE "GEFEST", Leningradskaya obi (RU)

( * ) Notice: Subject to any disclaimer, the term of this patent is extended or adjusted under 35 U.S.C. 154(b) by 0 days.

(21) Appl. No.: 15/513,153

(22) PCT Filed: Jul. 29, 2015

(86) PCT No.: PCT/RU2015/000474
§ 371 (c)(1),
(2) Date: Mar. 21, 2017

(87) PCT Pub. No.: WO2016/048190
PCT Pub. Date: Mar. 31, 2016

(65) Prior Publication Data

US 2017/0304664 A1 Oct. 26, 2017

(30) Foreign Application Priority Data

Sep. 22, 2014 (RU) ..... RU2014138307

(51) Int. Cl.
*A62C 37/11* (2006.01)
*A62C 37/40* (2006.01)
*A62C 37/14* (2006.01)

(52) U.S. Cl.
CPC ..... *A62C 37/11* (2013.01); *A62C 37/14* (2013.01); *A62C 37/40* (2013.01)

(58) Field of Classification Search
CPC ..... A62C 37/08; A62C 37/10; A62C 37/11; A62C 37/04; A62C 37/40
(Continued)

(56) References Cited

U.S. PATENT DOCUMENTS 3,834,463 A * 9/1974 Allard ..... A62C 37/10 169/28
3,924,688 A * 12/1975 Cooper ..... A62C 37/40 169/11

(Continued)

*Primary Examiner* — Tuongminh N Pham
(74) *Attorney, Agent, or Firm* — John Alumit

(57) ABSTRACT

The invention relates to fire-extinguishing means, and more particularly to sprinklers for fire-extinguishing systems. A sprinkler comprises a body with an outlet opening which is closed off by a check valve, and a unit for controlling the state of the check valve. The sprinkler is provided with a fire sensor and an activation unit. The unit for controlling the state of the check valve is equipped with an electric trigger device. The input pins of the activation unit are connected to the outputs of the fire sensor. The output pins of the activation unit are connected to the outputs of the electric trigger. The technical result is an increase in the response speed of the sprinkler.

2 Claims, 1 Drawing Sheet

(58) Field of Classification Search
USPC ..... 169/61, 56
See application file for complete search history.

(56) References Cited

U.S. PATENT DOCUMENTS

| | | | | | |
|---|---|---|---|---|---|
| 4,281,718 | A * | 8/1981 | Claussen | F16K 17/383 | 169/41 |
| 4,359,097 | A * | 11/1982 | Claussen | A62C 35/60 | 169/61 |
| 5,871,055 | A * | 2/1999 | Sundholm | A62C 31/05 | 169/16 |
| 6,896,066 | B2 * | 5/2005 | Gil | A62C 37/12 | 169/46 |
| 2002/0011570 | A1 * | 1/2002 | Castleman | G08B 17/12 | 250/339.15 |
| 2005/0121206 | A1 * | 6/2005 | Dolan | A62C 37/11 | 169/37 |
| 2007/0240886 | A1 * | 10/2007 | Kil | A62C 37/11 | 169/39 |

* cited by examiner

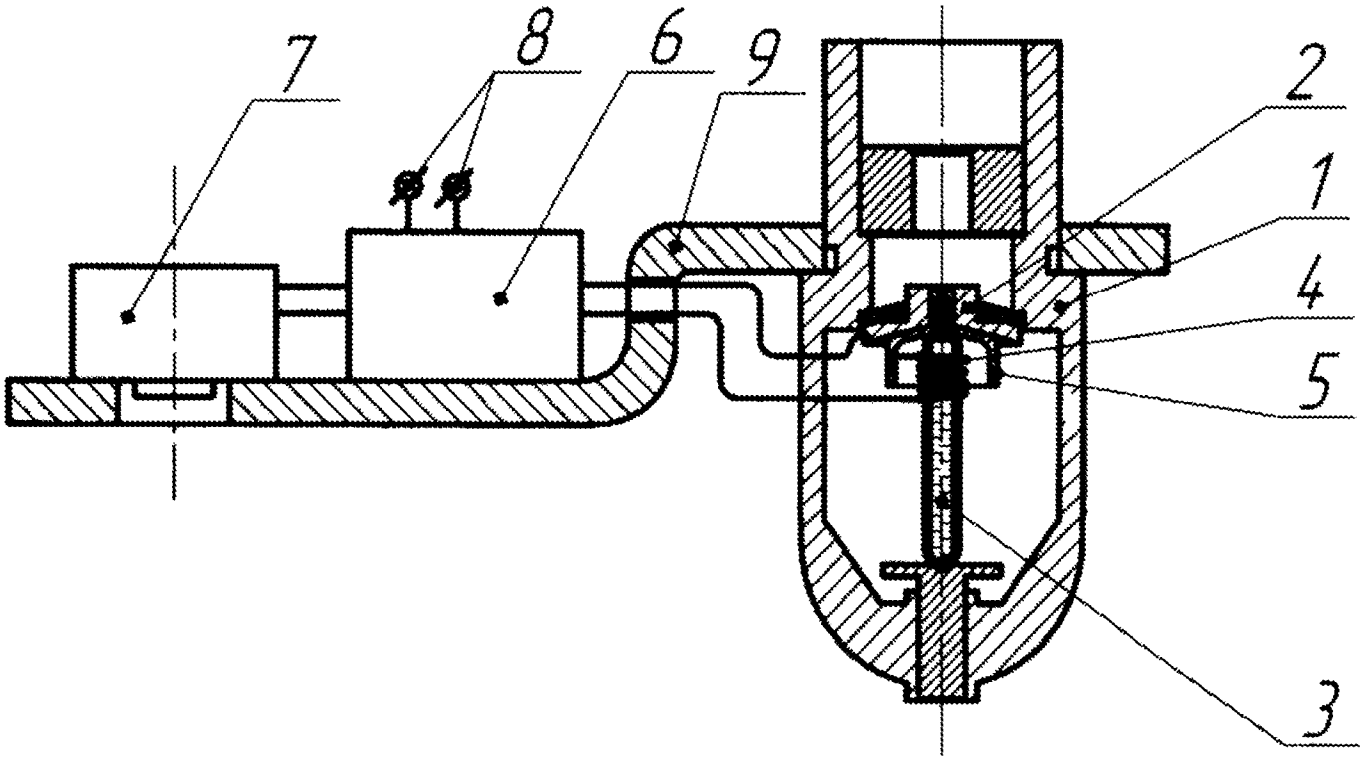
2
1
4
5
3
9
6
8
7

QUICK-RESPONSE SPRINKLER

BACKGROUND

The proposed technical solution relates to fire-extinguishing sprinklers and designated to supply a fire-extinguishing product in case of fire.

The prototype of the technical solution is a sprinkler (patent for prototype Russian Federation No. 79435 "Sprinkler").

A known device consists of the housing, shutoff valve connected to the fire sensor designed as an airtight glass flask, filled with a special liquid. The known device activates when fire sensor is destroyed due to thermal flow emitted by fire. A deficiency of this prototype is that it is slow acting.

A deficiency of this prototype is that it is known for its high response time at an initial stage of fire only. At the initial stage of fire, the thermal flow from the fire source has a low value so it takes a longer time to heat and destroy the sprinkler's fire sensor.

The purpose of the proposed technical solution is to make the sprinkler react faster.

SUMMARY

The proposed technical solution consists of a sprinkler, containing a housing with an outlet orifice covered by a shutoff valve, a shutoff valve control, and a fire sensor, which controls an area protected by the sprinkler and an activation unit.

Furthermore, the shutoff valve control is equipped with an electric trigger device, while outlets are connected with electric trigger outlets.

Preferable signal-activated sprinkler design options:

- the control unit contains a fire detector and an electric heater as an electric trigger device;
- A differential thermal detector (rate of rise) that detects a rise in temperature;
- an activation unit with activation unit inputs connected to the fire detector outputs
- activation unit outputs are connected with the electric heaters which are used as electric trigger devices, of neighboring sprinklers;
- the activation unit is placed within a fire detector housing;
- the connection of the activation unit with the heaters of neighboring sprinklers.

DESCRIPTION

The distinguishing features of the proposed technical solution are:

1. The sprinkler is also equipped with a fire detector, monitoring an area protected by the sprinkler, and an activation unit—feature 1. A heating element is used as the electric trigger device.
2. A shut-off valve controller is equipped with an electric trigger device—feature 2.
3. An activation unit inputs, and outputs connected to electric trigger—feature 3
4. A differential thermal fire detector (rate of rise) that detects a change in temperature—feature 4.
5. A directional fire detector that monitors an area coincident to the area protected by the sprinkler and capable of detecting an open flame therein—feature 5.
6. A directional flame detector as a directional fire detector—feature 6.

7. A fire detector designed with a removable sensor—feature 7.
8. An activation unit located within the fire detector housing—feature 8.
9. The sprinkler is also equipped with a bracket to which a fire detector is fastened—feature 9.
10. An activation unit is equipped with additional outlets to connect with electric trigger devices of neighboring sprinklers—feature 10.
11. A fire detector connected to the activation unit by a receiver—controller device—feature 11.

The proposed technical solution purpose is the following: To equip the sprinkler with a fire detector, monitoring an area protected by the sprinkler, and an activation unit (feature 1), where the shutoff valve controller is equipped with an electric trigger device (feature 2) and inputs of the activation unit are connected to a fire detector, and outputs of the activation unit are connected to an electric trigger device (feature 3). This can make the sprinkler act faster during an initial stage of fire because prolonged heating of a glass flask of the sprinkler is not necessary (in a known technical solution, a sprinkler is triggered from a thermal flow from a fire source). Speeding up the activation of the proposed sprinkler is done by forced impact to the shutoff valve controller, when the activation unit sends a signal to the shutoff valve controller when the fire detector that monitors an area protected by the sprinkler detects a local fire source. Using a differential thermal detector (rate of rise) as a fire detector that monitors an area protected by the sprinkler (feature 4) makes the sprinkler react faster because it is possible to activate the sprinkler immediately after detecting a change in temperature in the monitored area protected by the sprinkler. Using a directional flame detector (feature 5) as a fire fire detector that monitors an area protected by the sprinkler (feature 6), makes the sprinkler react faster, since there is an ability to activate the sprinkler immediately after detecting an open flame in the area coincident the area protected by the sprinkler. Using a fire detector that monitors an area protected by the sprinkler, designed with a removable sensor (feature 7) simplifies installation of components, included in the proposed sprinkler.

Using an activation unit located within the fire detector housing, monitoring the area protected by the sprinkler (feature 8) simplifies an installation of the proposed sprinkler. Equipping the sprinkler with a bracket, to which a fire detector, monitoring the area protected by the sprinkler is fastened (feature 9), simplifies installation of the proposed sprinkler.

Using an activation unit equipped with additional outputs to connect with electric trigger devices of neighboring sprinklers (feature 10) makes it possible to send an alarm to activate neighboring sprinklers to extinguish a fire when a fire source is detected in the sprinkler area. Communication between the fire detector and the activation unit through the receiver-controller device (feature 11) means that a programmed activation algorithm other sprinklers can be used.

The submitted drawing shows a general cross-sectional view of the fast-acting sprinkler.

The sprinkler consists of the housing (1), an output orifice with a shutoff valve (2), and shutoff valve controller, designed as a glass flask (3), filled with a special liquid. An electric trigger device (4), designed as a heating element is installed around the glass flask. The heating element outputs, through the normally closed contacts (5), are connected to activation unit outputs (8). Activation unit inputs are connected to fire sensor outputs (7), controlling an area protected by the sprinkler. The activation unit (6) is equipped with outputs (8) to connect with the power line and electric trigger device of this and other sprinklers. The sprinkler is equipped with a bracket (9), to which a fire sensor (7), controlling an area protected by the sprinkler, is fastened, and the activation unit (6).

The sprinkler works in a following way. When there is a fire in the area protected by the sprinkler, the fire detector (7) sends a signal to the activation unit (6). The activation unit (6) sends a signal to the heating element (4). A quick heating and destruction of the glass bulb (3) occurs, and the sprinkler's shutoff valve (2) is opened, whereupon the fire-extinguishing product is set upon the fire source. The local fire source is extinguished in the area protected by the sprinkler because the fire-extinguishing product is sprayed from the sprinkler.

What is claimed:

1. A signal-activated response fire sprinkler head consisting of:

a fire detector (7);

a housing (1) with an output orifice with a shut-off valve (2);

a heating element (4) disposed on a glass bulb (3) filled with a liquid;

a normally closed contact (5) directly connected between the shut-off valve (2) and the glass bulb (3);

the shut-off valve controlled by the glass bulb filled with the liquid; and an activation unit (6) connected to the heating element (4) and the fire detector (7), said fire detector, said activation unit, and said housing fastened to a bracket (9) of the signal-activated response fire sprinkler head;

said activation unit (6) also having additional outputs (8) connected to neighboring fire sprinkler heads by power lines;

wherein upon an occurrence of fire within a vicinity of the signal-activated response fire sprinkler heads, the fire detector sends a signal through the activation unit, to the heating element, the heating element destroys the glass bulb filled with the liquid, which opens the sprinkler shut-off valve, and a fire extinguishing product is released; and wherein upon reception by the activation unit of the signal from the fire detector, the activation unit through said additional outputs and said power lines sends a signal to heating elements of said neighboring fire sprinkler heads.

2. A system of a signal-activated response fire sprinkler head and neighboring sprinkler heads consisting of:

a fire detector (7);

a housing (1) with an output orifice with a shut-off valve (2);

a heating element (4) disposed on a glass bulb (3) filled with a liquid;

a normally closed contact (5) directly connected between the shut-off valve (2) and the glass bulb (3);

the shut-off valve controlled by the glass bulb; and an activation unit (6) connected to the heating element (4) and the fire detector (7), said fire detector, said activation unit, and said housing fastened to a bracket (9) of the signal-activated response fire sprinkler head;

said activation unit (6) also having additional outputs (8) connected to the heating elements of the neighboring fire sprinkler heads by power lines;

wherein upon an occurrence of fire within a vicinity of the signal-activated response fire sprinkler head, the fire detector sends a signal through the activation unit, to the heating element, the heating element destroys the glass bulb, which opens the sprinkler shut-off valve, and a fire extinguishing product is released; and wherein upon reception by the activation unit of the signal from the fire detector, the activation unit through said additional outputs and said power lines sends a signal to the heating elements of the neighboring fire sprinkler heads.

* * * * *